US006283205B1

(12) United States Patent
Cannon

(10) Patent No.: US 6,283,205 B1
(45) Date of Patent: Sep. 4, 2001

(54) POLYMERIC CENTRALIZER

(76) Inventor: James H. Cannon, P.O. Box 1306, Stafford, TX (US) 77497

( * ) Notice: Subject to any disclaimer, the term of this patent is extended or adjusted under 35 U.S.C. 154(b) by 0 days.

(21) Appl. No.: 09/488,068

(22) Filed: Jan. 19, 2000

(51) Int. Cl.[7] ..... E21B 17/10
(52) U.S. Cl. ..... 166/241.1; 166/241.6
(58) Field of Search ..... 166/241.1, 241.2, 166/241.4, 241.6, 241.7

(56) References Cited

U.S. PATENT DOCUMENTS

| | | | | |
|---|---|---|---|---|
| 1,560,468 | * | 11/1925 | Dodson | 166/241.4 |
| 2,153,787 | | 4/1939 | Anderson . | |
| 3,370,894 | * | 2/1968 | Pourchot | 166/241.4 |
| 3,414,337 | * | 12/1968 | Sable | 166/241.4 |
| 3,528,499 | | 9/1970 | Collett . | |
| 3,933,203 | | 1/1976 | Evans . | |
| 4,088,185 | | 5/1978 | Carson . | |
| 4,543,998 | | 10/1985 | Thomerson . | |
| 4,796,670 | | 1/1989 | Russell et al. . | |
| 4,858,688 | * | 8/1989 | Edwards et al. | 166/241.4 |
| 4,938,285 | | 7/1990 | Edwards . | |
| 5,154,867 | | 10/1992 | Edwards et al. . | |
| 5,247,990 | | 9/1993 | Sudol et al. . | |
| 5,339,896 | * | 8/1994 | Hart et al. | 166/241.1 |
| 5,452,760 | * | 9/1995 | Bertagnolli | 166/176 |
| 5,727,627 | | 3/1998 | Squires . | |
| 5,908,072 | | 6/1999 | Hawkins . | |
| 6,032,748 | * | 3/2000 | DeBray et al. | 175/325.7 |

FOREIGN PATENT DOCUMENTS

| | | | | |
|---|---|---|---|---|
| 3700793 A1 | | 7/1988 | (DE) | E21B/17/10 |
| 4029523 | * | 12/1991 | (DE) | 166/241.2 |
| 0 274 235 A2 | | 7/1988 | (EP) | E21B/17/10 |
| WO 98/37302 | | 8/1998 | (GB) | E21B/17/10 |
| WO 98/50669 | | 12/1998 | (WO) | E21B/17/10 |

OTHER PUBLICATIONS

PCT International Search Report.

* cited by examiner

*Primary Examiner*—Frank Tsay
(74) *Attorney, Agent, or Firm*—Robert W. Strozier

(57) ABSTRACT

A polymeric centralizer for casing having a body adapted to fit closely about the casing, a plurality of blades extending substantially longitudinally along an outer surface of body, a slit through a blade and opposing groove to allow the centralizer to be spread apart and a fastener to pulling the slit together and tightening the centralizer about the casing. The polymeric centralizer having strength characteristics capable of withstanding the forces encountered in casing operations. The polymeric centralizer is non-sparking for use in hazardous environments, abrasion and wear resistant, and provides protection from electrolysis between adjacent casing strings. The polymeric centralizer is light weight, allowing increased transportation capacity at a economical cost and allows easy attachment to broken down or made-up piping, production string or casing and including hole or cutaways for receiving surface cabling.

20 Claims, 8 Drawing Sheets

POLYMERIC CENTRALIZER

BACKGROUND OF THE INVENTION

1. Field of the Invention

The present invention relates to a polymeric centralizer for centering pipe strings in well bores or within in other pipe strings which can be easily fitted onto a production string or casing during down hole insertion.

More particularly, the present invention relates to a polymeric centralizer for centralizing pipe strings in well bores and within in other pipe strings including a plurality of blades or fins extending substantially longitudinally along an outer surface of the centralizer, a slit through a blade opposite a groove for opening the centralizer so it can be fitted onto a production string or casing, a fastener means for securing or tightening the centralizer to the string or casing and cutaways for allowing wirelines or cables to pass between the centralizer and the production string to protect the cable, where the centralizer is wear and abrasion resistant, safe for use in hazardous environments and does not contribute to metal contamination of the well.

2. Description of the Related Art

In the completion of oil and gas wells it is standard practice to set or cement at least one string of casing within the well bore. Casing strings are cemented in the well bore to prevent fluids from migrating from the production zone through the annulus between the casing string and the well bore to the surface or other zones where for example fresh water may be contaminated. In addition, there are regulations which require that some zones be cemented off.

In cementing a casing string, a cement slurry is pumped down the interior of the casing string, out the lower end, into the annulus between the string and the well bore. However, to effect an efficient cementing job, the complete annulus needs to be cemented without pockets in the cement and without areas in which the string is contacting the wall of the well bore. To facilitate obtaining an effective cementing job the casing is commonly centered in the well bore with centralizers which are disposed about the casing string. In addition, the centralizers aide in running the pipe into the hole without hanging up.

Centralizers may also be used on casing or pipe strings, such as tubing, which are hung within another string of casing or pipe. These inner strings may be cemented within the outer pipe string or they may not be.

Centralizers for casing, tubing or pipe commonly are constructed of a low carbon steel having a tubular body or sleeve adapted to fit around a pipe joint. These prior art centralizers usually include outwardly bowed springs having opposing ends connected to opposite ends of the sleeve. Although the resiliency of the bow strings enables them to move through tight spots in the well bore, they may not support the weight of the casing string, especially in a highly deviated well bore.

In another type prior art centralizer, the bow strings are replaced by solid strips of metal which are tapered at each end to provide outer spaced bearing surfaces for engaging the well bore or the outer casing. Although less prone to collapse than bow springs under the weight of the casing string, these metal strips are often not strong enough to prevent bending upon contacting an obstruction or turn in the well bore. As a result, the centralizer and the casing may become wedged in the well, and, in any case become unsuitable for providing a suitable cementing job.

Another type of prior art centralizer is a non-metallic sleeve centralizer disclosed in U.S. Pat. No. ; 5,908,072.

These prior art metal centralizers have further drawbacks, especially, when run and set within another string of pipe. One of the drawbacks of metal centralizer is contact with the outer pipe when the string vibrates. Metal to metal contact may cause a spark, which can be very hazardous in the hydrocarbon filled well. Also, metal centralizers can create a corrosion problem with the casing strings which it contacts through electrolysis. Metal centralizers also are susceptible to damage when running acid and circulating the acid back out of the hole. Additionally, there is a concern with scrapping the inner diameter of stainless steel tubing when running stainless/duplex stainless steel tubing having metal centralizers. The non-metallic sleeve centralizers overcome some of these disadvantages, but sleeve type centralizer are difficult to attach to pre-connected strings.

It would be a benefit, therefore, to have a polymeric centralizer adapted to fit about a string of pipe for centering the pipe in a well bore or within an outer string of pipe such as a production riser which can be easily attached to the string prior to or after make-up. It would be further benefit to have a polymer centralizer that can be used with downhole operations that require control cabling or umbilicals or wirelines where the cabling can be inserted through slots or cutaways in the centralizer.

SUMMARY OF THE INVENTION

The present invention provides a polymeric centralizer for centering a production string or casing within a well bore or within another string of casing or a riser including a plurality of fins or blades extending substantially longitudinally along an outer surface of the centralizer, a slit through a blade opposite a groove which cooperate to allow the centralizer to open so it can be fitted onto a production string or casing, a fastener means for securing the centralizer to the string or casing and cutaways for receiving and protecting wires, cables, umbilicals or other continuous cabling leading from the surface, where the centralizer has structural strength capable of withstanding the forces exerted by a string of pipe contacting a well bore or an outer string of pipe, is non-sparking when contacting metal pipe strings, does not promote electrolysis when in contact with a pipe string and provides cathodic protection between strings of pipe, is resistant to acid, is inexpensive to manufacture and is lightweight and has the tensile and compressive strength required to withstand the forces encountered in centralizing casing as opposed to the forces encountered by sucker rod guides and tube spacers. These centralizers are ideally suited for use with titanium risers attached to floating vessels where the centralizers centers and protects the inner surface of the riser from being damaged during the insertion of production strings.

The present invention also provides a drill or casing string and a plurality of centralizer fitted thereto for centering casing within a well bore or within another string of casing, where the centralizer includes a plurality of fins or blades extending longitudinally along an outer surface of the centralizer, a slit through a blade opposite a groove for opening the centralizer so it can be fitted onto a production string or casing, a fastener means for securing the centralizer to the string or casing and cutaways for allowing wirelines, electrical cables or other continuous cabling leading from the surface to a given distance below the surface.

The present invention provides a method for protecting a production string including the step of attaching to the string at regular or irregular intervals a plurality of centralizers of the present invention.

The present invention also provides a method for protecting a production string or casing including the steps of lowering a production string or casing into a well bore and attaching a polymeric centralizer of the present invention to the string or casing at intervals separated by a distance sufficient to prevent the production string or casing from contacting the well bore or inner pipe to reduce wear and tear and damage to the string or casing.

The present invention further provides a method for fitting a centralizer to a production string or casing including the step of opening the centralizer at a slit through a blade opposite a groove, forcing the opened centralizer over the production string or casing and tightening a fastener to draw the slit tight together and secure the centralizer to the string or casing.

Preferably, the blades have a bearing surface for bearing against a well bore or an outer casing in which the string or casing carrying the centralizer is disposed. The blades extend outwardly from the centralizer to space the carrying string from the well bore or outer casing string.

It is also preferred that the blades have opposing ends tapered outwardly toward one another. However, it is not necessary that the blade ends be tapered. It may also be desired to have the blades sweep at an angle as they extend longitudinally down the sleeve.

The polymeric centralizer may be positioned on the pipe and allowed to float between the collars at adjacent casing joint connections. The centralizer may be connected to the casing joint by an adhesive. The centralizer may be connected to the casing joint by set screw which are adjustably disposed through the centralizer so as to engage the casing joint. The centralizer may be connected to joint and cable protectors such as coupling protectors made by Cannon Services, Inc. of Missouri City, Tex. and described U.S. Pat. No. 4,615,543, incorporated herein by reference. The centralizer may be fixedly connected to the casing joint via stop collars or rings connected to the casing string adjacent opposing ends of the centralizer. The stop rings may be of any type well known in the art such as the Frank's SB stop ring.

Additionally, the stop rings may be constructed of the same or similar polymeric as the centralizers of this invention. Preferably, a stop collar formed of the same or substantially same polymeric material as the centralizer would include an outer ring, an inner ring positioned between the outer ring and the casing joint to be engaged and having an inner face for gripping the casing joint, and an activating mechanism for securing the inner ring to the outer ring and facilitate engagement with the casing joint.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
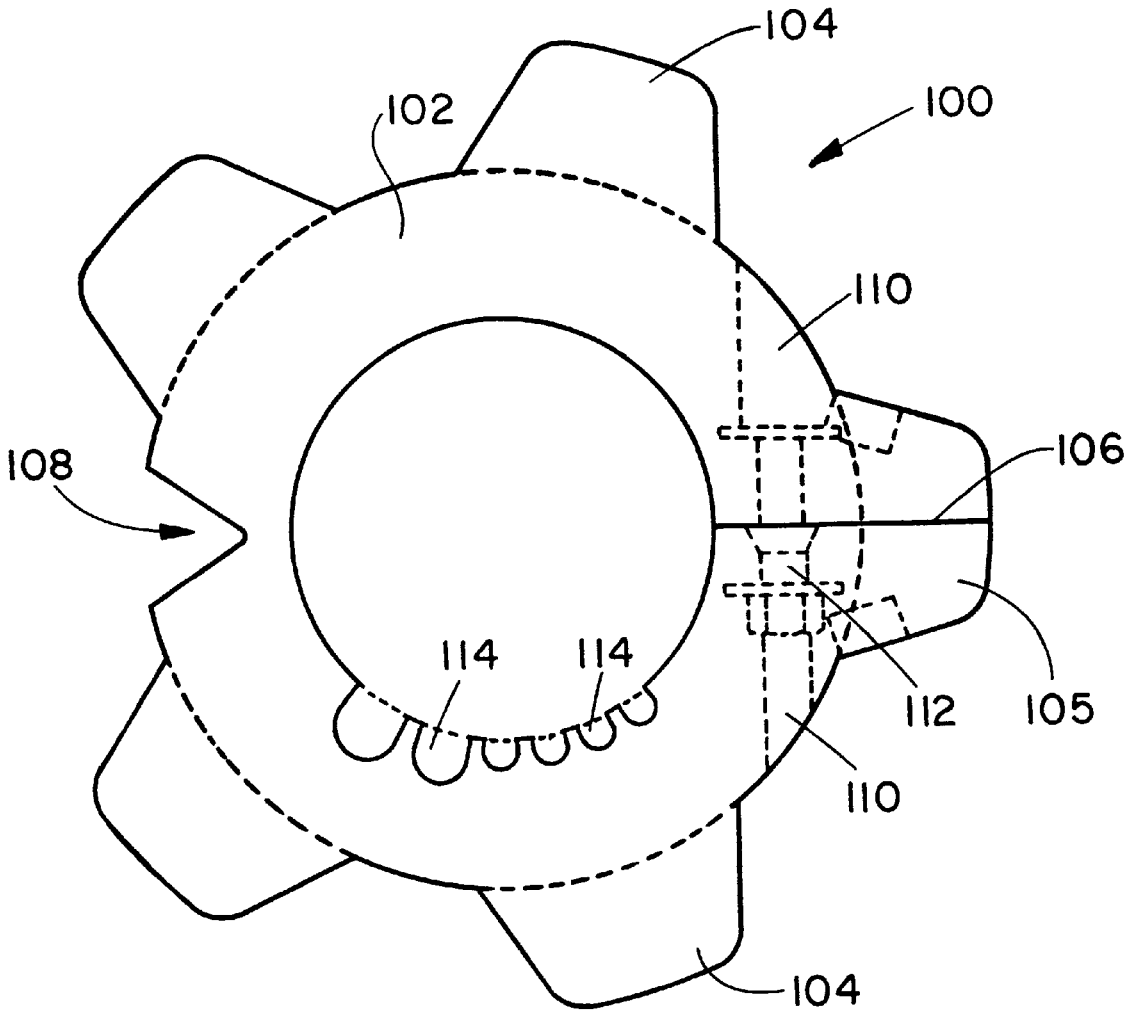
FIG. 1 is a top view of one embodiment of a polymeric centralizer of this invention.

The inventors have found that a polymeric centralizer can be constructed for use on production string or casing where the centralizer includes a slit through a blade opposite a groove or thin portion of the centralizer for opening the centralizer and fitting the centralizer over the string or casing with cutaways to protect surface cabling extending along a length of the string. Such a centralizer is ideally suited for use downhole operations such as drilling, completion, testing or the like.

The present invention broadly relates to a centralizer including a plurality of longitudinally extending blades or fins, a slit through a blade opposite groove for opening the centralizer so it can be fitted onto a production string or casing string or production riser and a fastener for bringing the slit together and tightening the centralizer onto the string or casing. Preferably, the centralizer also includes an inner cutaway or plurality of cutaways to accommodate cabling or wires extending from the surface down the length of the string.

The present invention also broadly relates to a method for protecting and centering a production string in a well bore or outer casing or production riser including attaching a plurality of centralizers of the present invention at intervals along the string to keep the string centered in the well bore or outer casing or riser and protected from contacting the well bore or outer casing or riser.

The present invention also broadly relates to a method for protecting cabling and centering a production string in a well bore or outer casing or production riser including attaching a plurality of centralizers of the present invention at intervals along the string to keep the string centered in the well bore or outer casing or riser and protected from contacting the well bore or outer casing or riser and running cabling through the cutaways in the centralizer.

The present invention also relates to a production string comprising sections of piping joined at joints each joint fitted with a joint protector and a plurality of centralizers of this invention fitted onto the string at space apart intervals sufficient to maintain the string substantially in the center of the well bore or inside an outer tubing or riser and a cable extending from the surface and running through the joint protectors and centralizer cutaways where the joint protectors and centralizers act to protect the cable as the string is inserted into or removed from the well bore or outer tubing.

The present invention also relates to a method for protecting a production string of tubing including the steps of opening a plurality of centralizer of this invention at each slit, pushing the centralizer over the tubing a spaced apart intervals sufficient to substantially center the string in a well bore or outer tubing and securing the centralizer onto the tubing at the intervals by tightening the fasteners.

The present invention also relates to a method for protecting a cable accompanying string of production tubing including the steps of attaching a joint protector to each joint in the string, attaching a plurality of centralizer of this invention to the string at spaced apart intervals sufficient to substantially center the string in a well bore or outer tubing or riser and threading the cabling through the protectors and the centralizers to protect the cable during insert into and removal from the well bore or outer tubing.

Suitable polymers for making the centralizers of the present invention include, without limitation, an engineering thermoplastic such as an acetal resins e.g., Delrin® from DuPont or other similar injection moldable polymers. The polymers should have a tensile strength between about 8,000 psi and about 14,000 psi at 73° F., a Tensile modulus of elasticity at 73 ° F. between about 400,000 psi and about 550,000 psi, an elongation of about at 73 ° F. between about 30% and 60%, a flexural strength at 73° F. between about 13,000 psi and about 16,000 psi, a flexural modulus of elasticity at 73° F. between about 350,000 psi and about 600,000 psi, a shear strength at 73° F. between about 7,000 psi to about 10,000 psi, a compressive strength at 10% deformation between about 15,000 psi and about 20,000 psi, dynamic coefficient of friction 0.25, Rockwell hardness at 73° F. between about 115 to about 125, coefficient of linear thermal expansion between about $5\times10^{-4}$ and about $7\times10^{-4}$ in/in/° F., deformation under load (122° F. and 2,000 psi) of about 0.7 to about 1.1%, deflection temperature at 264 psi between about 225 and about 260° F., melting point of crystalline part of composition between about 325 and about 350° F., continuous service temperature in air (max) of about 180° F., dielectric strength short time between about 350 and about 550 V/nul, volume resistivity between about $1\times10^{13}$ and about $1\times10^{16}$ OHM·cm, dielectric constant at 60Hz of about 3.7, dielectric constant at $10^5$Hz of about 3.7, dielectric constant at $10^6$Hz of about 3.7, and acceptable water, acid, base and solvent resistance. The thermoplastic is generally mixed with other ingredients to improve physical properties and lifetime such as fillers, antidegradants, or other common additives. The preferred thermoplastic composition is Celleprin 60 available for BJ Molding of Houston.

The centralizers of this invention are ideally suited for tubing having a dimension between about 3" and about 6", although centralizers can be fabricated for any other diameter tubing. The body thickness for 3.5" id is between about 0.75" and about 1.5", preferably between about 1" and about 1.5" and particularly between about 1" and about 1.25". The blade thickness from the body is between about 0.75" and about 1.25" and preferably between about 1" and about 1.2". The distance between blades on the body is between about 1.2" and about 1.4", but the blades separation near the groove is slightly smaller. For a 3.5 i.d., the o.d. of the centralizer profile is between about 7.75" and about 8.5", but a larger and smaller o.d. is a matter of design choice. The groove depth should be sufficient to allow the centralizer to be opened at the slit through a blade opposite the groove, but not so deep that the centralizer is significantly weakened at the interior of the groove. If the body is about 1.25" thick, then the groove depth is between about 0.6" and 0.85", but the depth is more a design consideration.

The present invention is more fully described in reference to the following Figures and their description which are presented for illustration and not for limitation. It should be recognized that the implementation represented by the Figures is only one implementation of many that would function equivalently.

Figure 2:
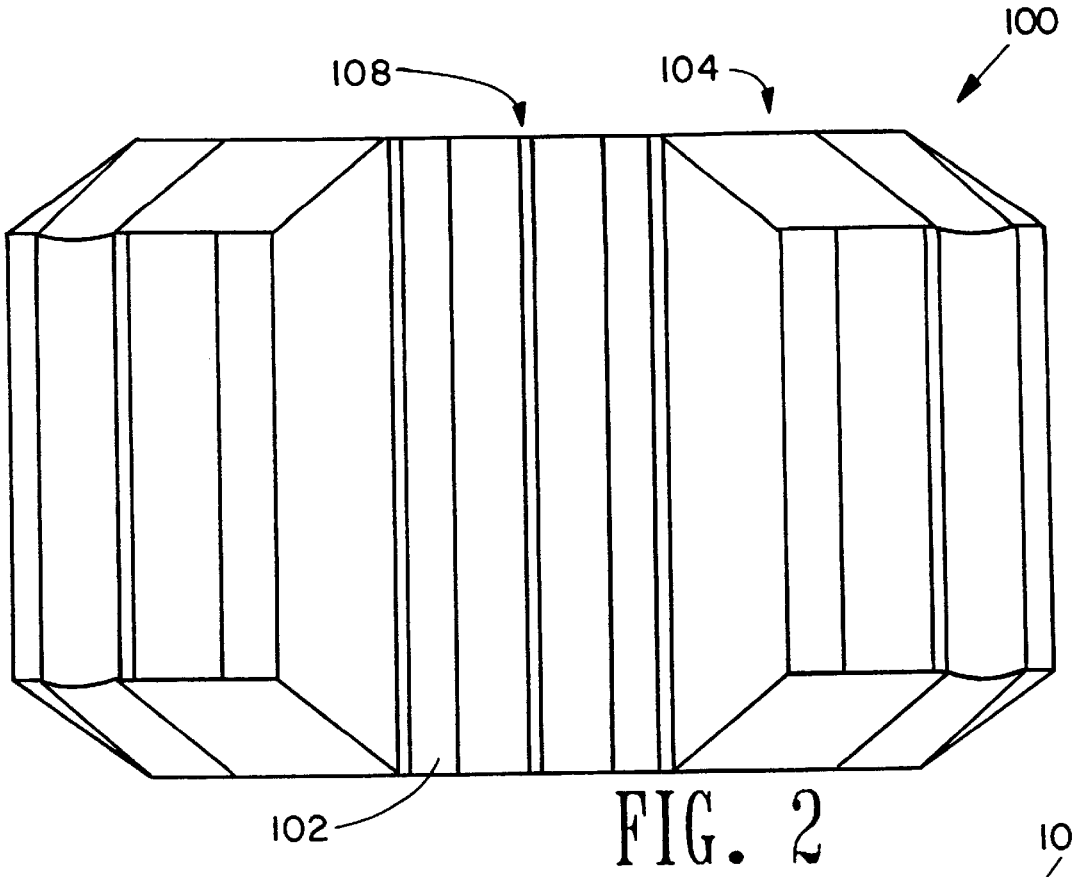
FIG. 2 is a first side view of the centralizer of FIG. 1 showing the groove.
Figure 3:
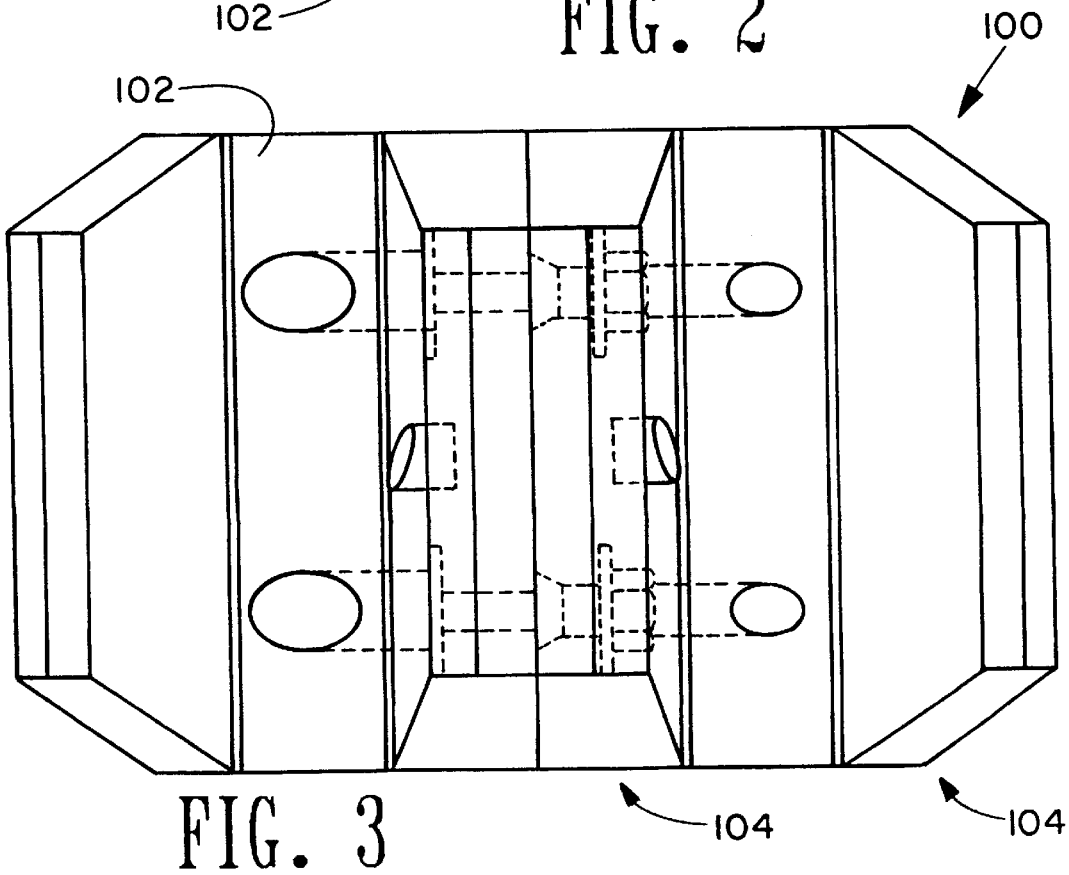
FIG. 3 is a second side view of the centralizer of FIG. 1 showing the fastener.
Figure 4:
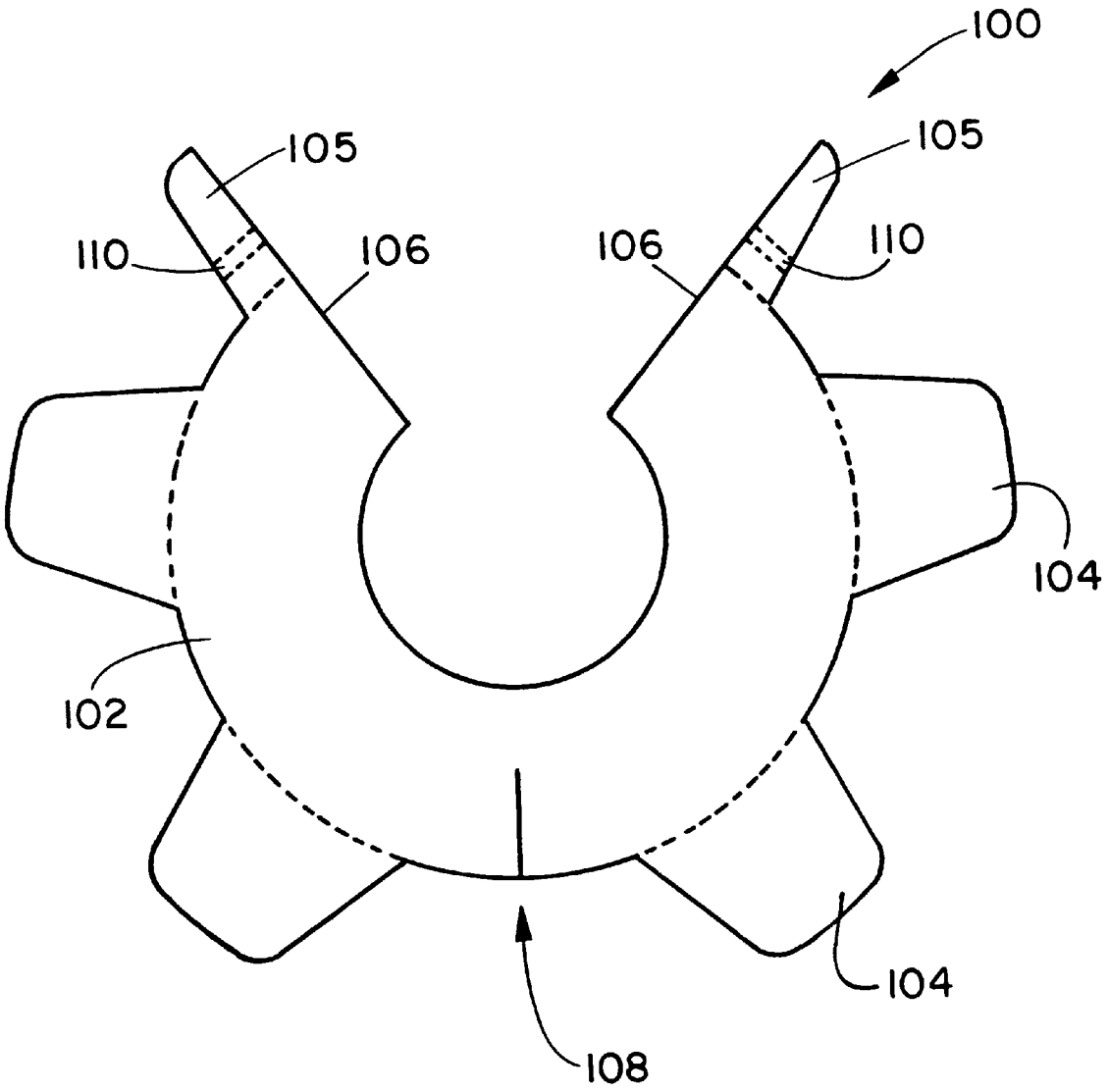
FIG. 4 shows the centralizer of FIG. 1 in its opened state for fitting over a pipe.

Referring now to FIGS. 1 to 3, one embodiment of a centralizer, generally 100, of the present invention is shown to include a body 102, a plurality of blades 104 extending longitudinally along a length of the body 102, a slit 106 through the blade 105 opposite a groove 108 and oppositely disposed holes 110 for receiving fasteners 112 shown here as nuts and bolts, but any fastener means can be used as well. The centralizer 100 also includes a plurality of arcuate cutaways 114 for receiving and protecting cabling extending from the surface along a length of a string of pipe onto which the centralizer 100 is fitted. The slit 106 and the groove 108 are designed so that the centralizer 100 can be put in an opened condition for fitting over a pipe as shown in FIG. 4.

Figure 5:
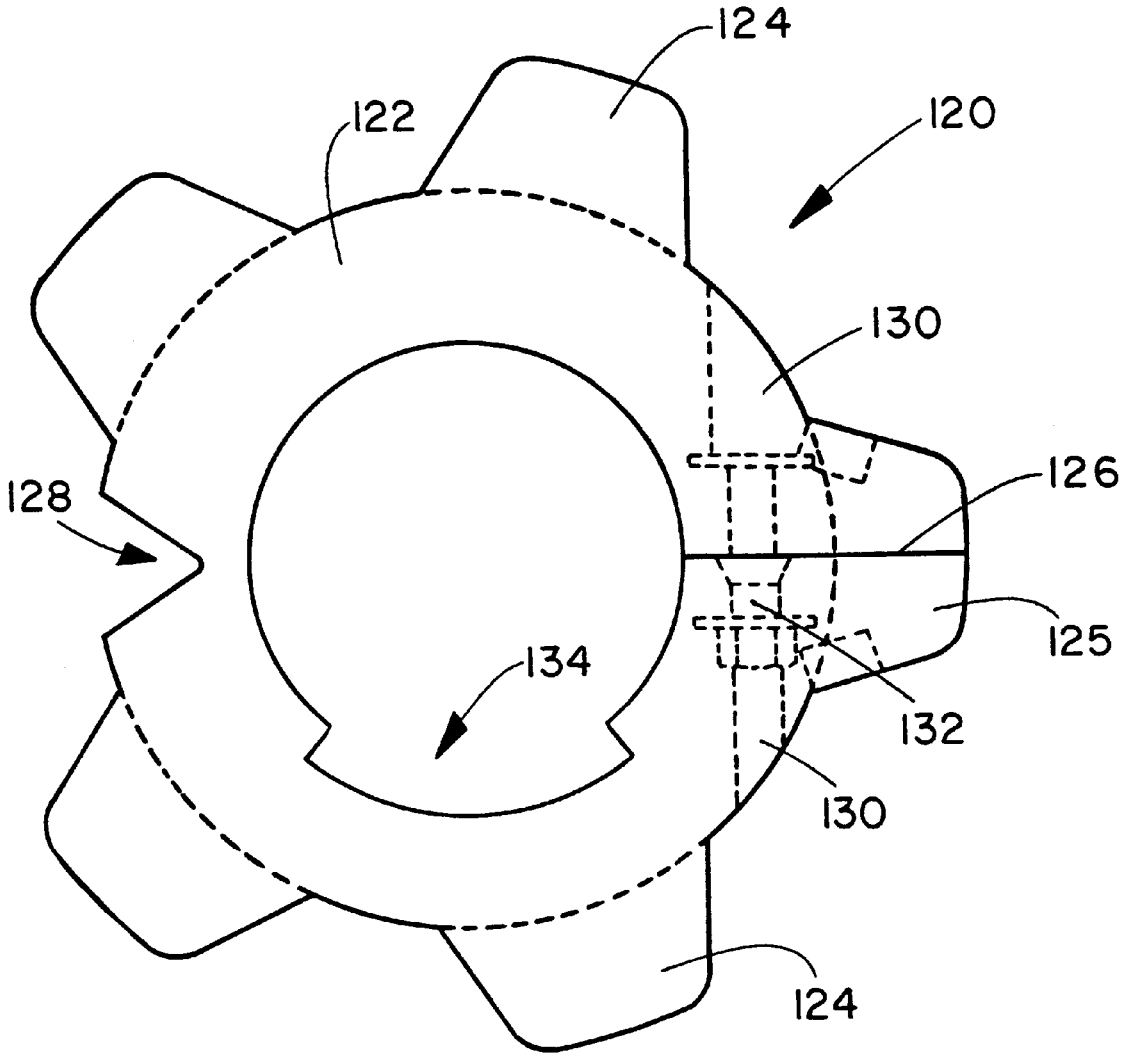
FIG. 5 is a top view of another embodiment of a polymeric centralizer of this invention.

Referring now to FIG. 5, another embodiment of a centralizer, generally 120, of the present invention is shown to include a body 122, a plurality of blades 124 extending longitudinally along a length of the body 122, a slit 126 through the blade 125 opposite a groove 128 and oppositely disposed holes 130 for receiving fasteners 132 shown here as nuts and bolts, but any fastener means can be used as well. The centralizer 120 also includes a channel cutaway 134 for receiving and protecting cabling extending from the surface along a length of a string of pipe onto which the centralizer 120 is fitted.

Figure 6:
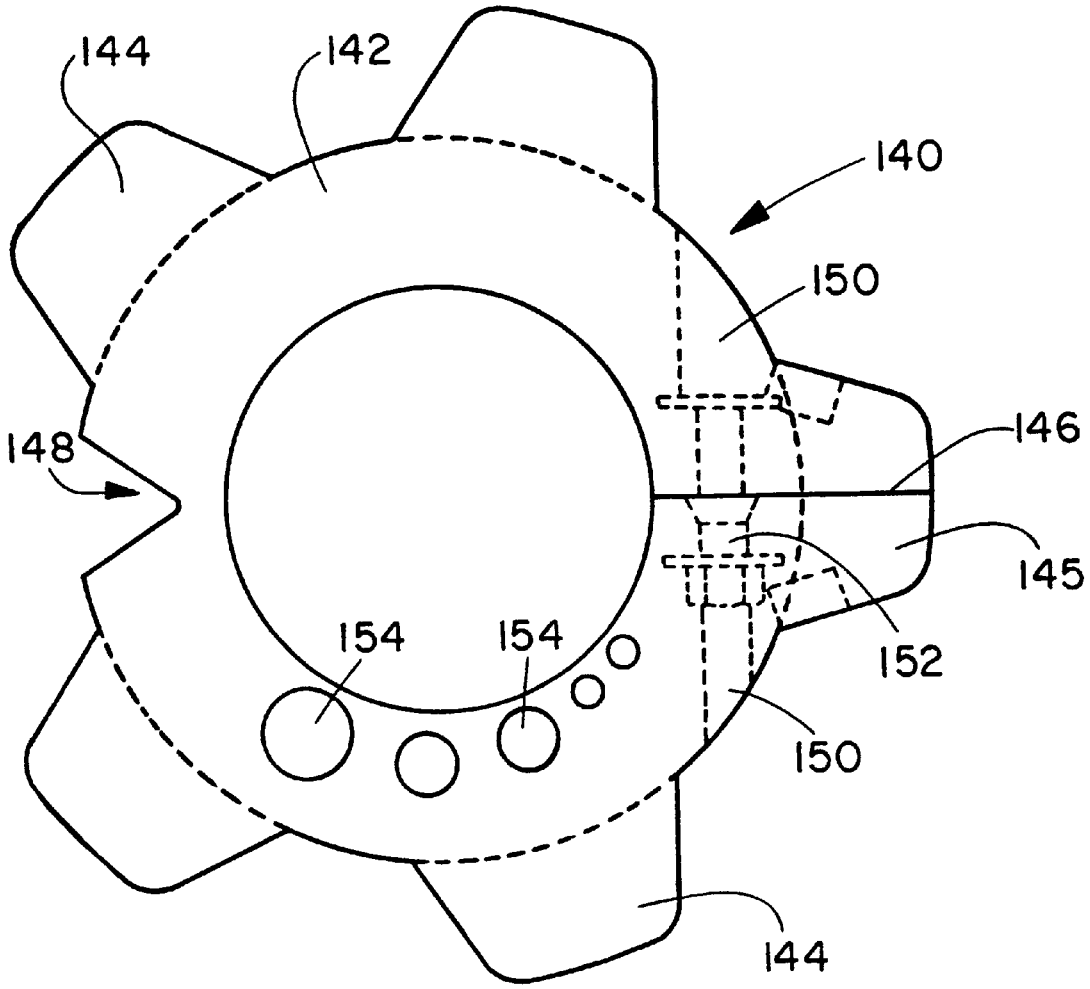
FIG. 6 is a top view of another embodiment of a polymeric centralizer of this invention.

Referring now to FIG. 6, another embodiment of a centralizer, generally 140, of the present invention is shown to include a body 142, a plurality of blades 144 extending longitudinally along a length of the body 142, a slit 146 through the blade 145 opposite a groove 148 and oppositely disposed holes 150 for receiving fasteners 152 shown here as nuts and bolts, but any fastener means can be used as well. The centralizer 140 also includes holes 154 for receiving and protecting cabling extending from the surface along a length of a string of pipe onto which the centralizer 140 is fitted.

Figure 7:
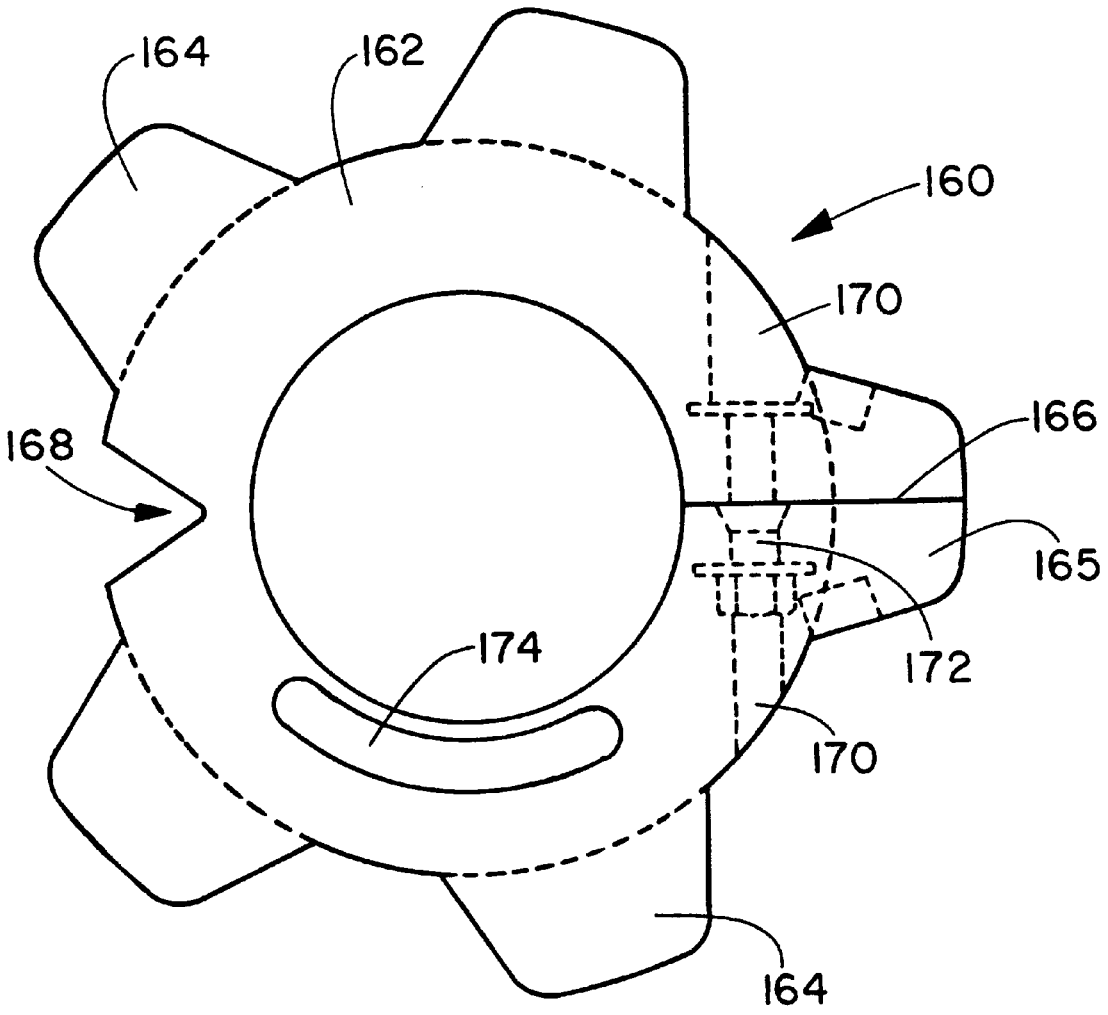
FIG. 7 is a top view of another embodiment of a polymeric centralizer of this invention.

Referring now to FIG. 7, another embodiment of a centralizer, generally 160, of the present invention is shown to include a body 162, a plurality of blades 164 extending longitudinally along a length of the body 162, a slit 166 through the blade 165 opposite a groove 168 and oppositely disposed holes 170 for receiving fasteners 172 shown here as nuts and bolts, but any fastener means can be used as well. The centralizer 160 also includes a slot 174 for receiving and protecting cabling extending from the surface along a length of a string of pipe onto which the centralizer 160 is fitted.

Figure 8:
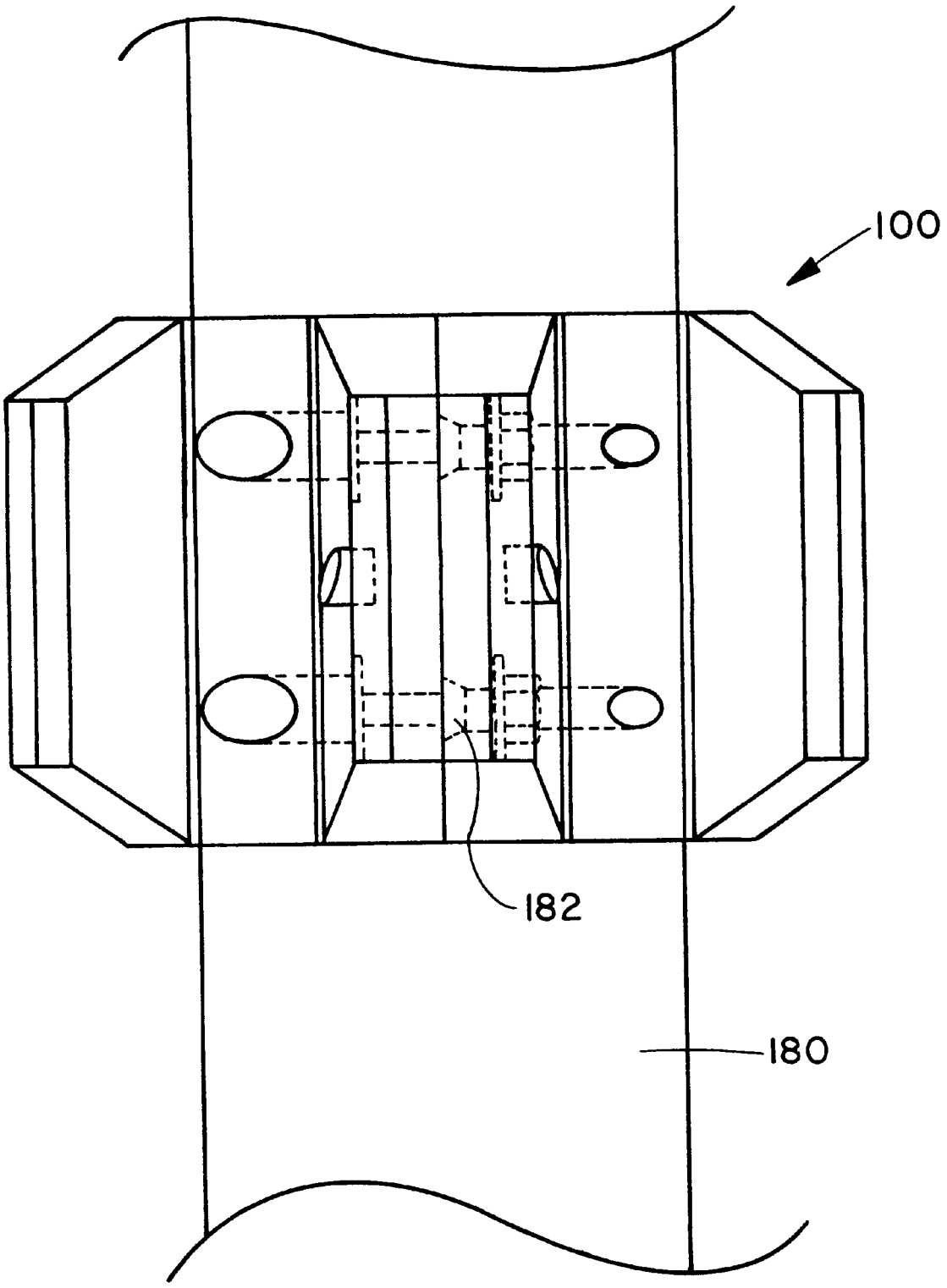
FIG. 8 is a front view of the centralizer of FIG. 1 secured to a pipe.

Referring now to FIG. 8, a centralizer 100 of FIG. 1 secured to a section of pipe 180 by nuts and bolts 182.

Figure 9:
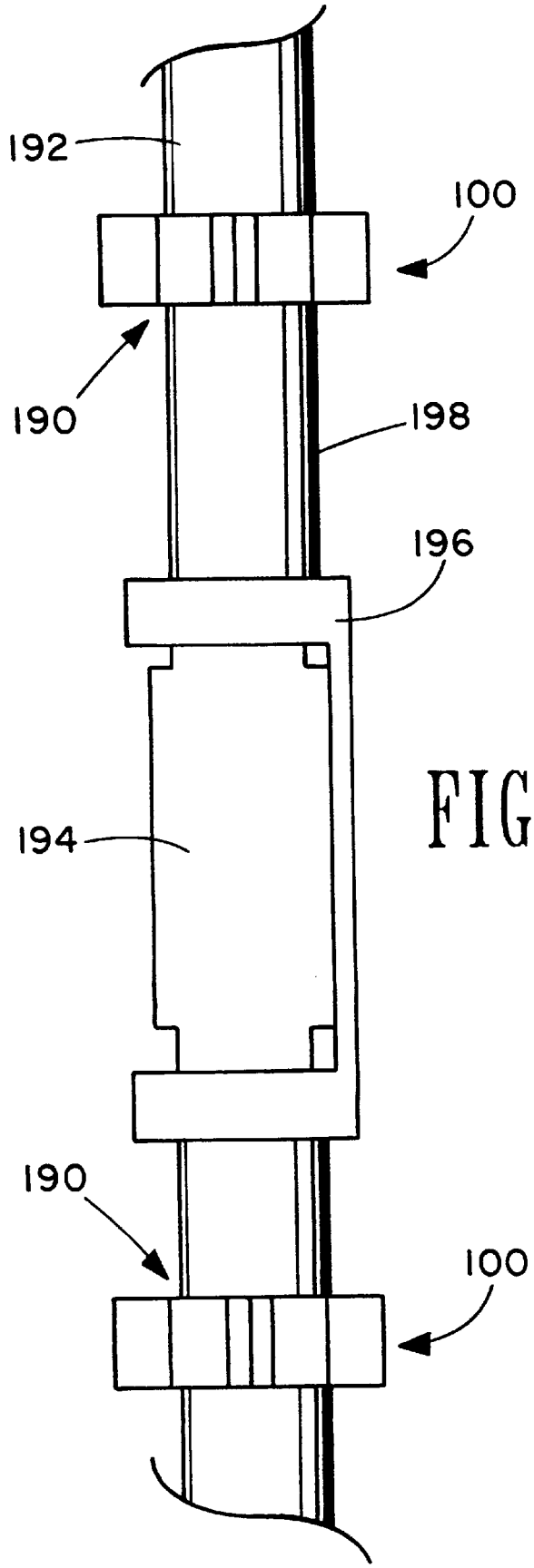
FIG. 9 is a perspective view of two centralizer of FIG. 1 secured to a section of a string including a joint and a joint protector showing cabling extending along the string.

Referring now to FIG. 9, a plurality of centralizers 100 of FIG. 1 positioned at intervals 190 along a pipe string 192 including a joint 194 protected by a joint protector 196 and a cable 198 running along the string 192 through one of the cutaways 114 and into and through the joint protector 196.

It can be seen from the preceding description that a polymeric centralizer for centering a string of pipe within a well bore or another string of pipe which provides ease of attachment after string make-up having a slit through a blade and oppositely disposed groove and structural strength capable of withstanding the forces exerted by a string of pipe contacting a well bore or an outer string of pipe, is non-sparking when contacting metal pipe strings, does not promote electrolysis when in contact with a pipe string and provides cathodic protection between strings of pipe, and is resistant to acid has been provided.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A centralizer comprising a body, longitudinally extending blades extending along a length of the body, a slit formed through a blade opposite a groove for spreading the centralizer into a opened condition and a fastener for pulling the slit together and tightening the centralizer.

2. The centralizer of claim 1, wherein the blades have a bearing surface for bearing against a well bore or an outer casing in which said casing carrying said centralizer is disposed.

3. The centralizer of claim 1, wherein the blades have opposing ends tapered outwardly toward one another.

4. The centralizer of claim 1, further comprising an interior cutaway, a slot or a hole extending a length of the centralizer adapted to permit cabling to pass therethrough.

5. The centralizer of claim 1, wherein the centralizer is formed by reaction injection molding.

6. The centralizer of claim 1, further comprising opposing holes adjacent the slit for receiving bolt fasteners.

7. The centralizer of claim 1, further comprising a plurality of slots, holes or interior cutaways extending a length of the centralizer adapted to permit cabling to pass therethrough.

8. A non-metallic centralizer for casing comprising:

a body, longitudinally extending blades extending along a length of the body, a slit formed through a blade opposite a groove for spreading the centralizer into a opened condition and a fastener for pulling the slit together and tightening the centralizer.

9. The centralizer of claim 8, wherein the blades having a bearing surface for bearing against a well bore or an outer casing in which the casing carrying the centralizer is disposed.

10. The centralizer of claim 8, wherein the blades have opposing ends tapered outwardly toward one another.

11. The centralizer of claim 8, further comprising an interior cutaway, a slot or a hole extending a length of the centralizer adapted to permit cabling to pass therethrough.

12. The centralizer of claim 8, further comprising a plurality of slots, holes or interior cutaways extending a length of the centralizer adapted to permit cabling to pass therethrough.

13. A polymeric centralizer for tubing comprising a body, a plurality of blade, a slit in a blade opposite a groove adapted to allow the centralizer to open and a fastener system for pulling the slit together and tightening the centralizer about a section of tubing where the centralizer is made of a thermoplastic.

14. The centralizer of claim 13, wherein the blades having a bearing surface for bearing against a well bore or an outer casing in which said casing carrying said centralizer is disposed.

15. The centralizer of claim 13, wherein the blades have opposing ends tapered outwardly toward one another.

16. The centralizer of claim 13, further comprising an interior cutaway, a slot or a hole extending a length of the centralizer adapted to permit cabling to pass therethrough.

17. The centralizer of claim 13, further comprising a plurality of slots, holes or interior cutaways extending a length of the centralizer adapted to permit cabling to pass therethrough.

18. A production string comprising: (a) sections of piping joined at joints, each joint fitted with a joint protector, and (b) a plurality of centralizers of claim 1 fitted onto the string at space apart intervals sufficient to maintain the string substantially in the center of the well bore or inside an outer tubing or riser and a cable extending from the surface and running through the joint protectors and the centralizer via a cutaway, slot or hole extending a length of each centralizer where the joint protectors and centralizers act to protect the cable as the string is inserted into or removed from the well bore or outer tubing or riser.

19. A method for protecting a production string including the steps of: (a) opening a plurality of centralizer of claim 1 at each slit, (b) pushing the centralizer over the tubing a spaced apart intervals sufficient to substantially center the string in a well bore or outer tubing or riser and (c) securing the centralizer onto the tubing at the intervals by tightening the fasteners.

20. A method for protecting a cable accompanying a production string including the steps of: (a) attaching a joint protector to each joint in the string, (b) attaching a plurality of centralizer of claim 1 to the string at spaced apart intervals sufficient to substantially center the string in a well bore or outer tubing or riser and (c) threading the cabling through the protectors and through a cutaway, slot or hole in the centralizers to protect the cable during insert into or removal from the well bore or outer tubing.

* * * * *